United States Patent [19]

Miller

[11] 4,194,450

[45] Mar. 25, 1980

[54] RAILWAY HOPPER CAR DOOR OPERATING MECHANISM

[75] Inventor: Roy W. Miller, Highland, Ind.

[73] Assignee: Pullman Incorporated, Chicago, Ill.

[21] Appl. No.: 864,342

[22] Filed: Dec. 27, 1977

[51] Int. Cl.[2] ..... B61D 7/04; B61D 7/06; B61D 7/18; B61D 7/26

[52] U.S. Cl. ..... 105/253; 105/290; 105/299; 105/304

[58] Field of Search ..... 105/240, 241 C, 248, 105/250, 251, 253, 290, 299, 300, 304, 306; 222/129; 260/453 A; 361/384

[56] References Cited

U.S. PATENT DOCUMENTS

| | | | |
|---|---|---|---|
| 686,902 | 11/1901 | Müller et al. | 105/290 |
| 775,402 | 11/1904 | Hitchcock | 105/290 |
| 789,155 | 5/1905 | Kiesel | 105/290 X |
| 1,284,111 | 11/1918 | Kestler | 105/300 X |
| 2,893,327 | 7/1959 | Lunde | 105/290 X |
| 3,122,106 | 2/1964 | Novelli | 105/240 |
| 3,169,491 | 2/1965 | Darlington et al. | 105/240 |
| 3,295,704 | 1/1967 | Gillick et al. | 105/240 X |
| 3,316,457 | 4/1967 | Klos | 361/384 |
| 3,316,857 | 5/1967 | Floehr | 105/240 |
| 3,339,500 | 9/1967 | Dorey | 105/253 |
| 3,343,725 | 9/1967 | Cannon | 222/129 |
| 3,361,814 | 1/1968 | Campbell et al. | 260/453 A |
| 3,408,956 | 11/1968 | Rebenok et al. | 105/240 |
| 3,450,065 | 6/1969 | Floehr et al. | 105/304 |
| 3,540,382 | 11/1970 | Dorey | 105/240 |
| 3,596,608 | 8/1971 | Aquino et al. | 105/240 X |
| 3,631,814 | 1/1972 | Shaver | 105/241 C |
| 3,654,873 | 4/1972 | Floehr | 105/248 |
| 3,800,711 | 4/1974 | Tuttle | 105/251 |
| 3,872,796 | 3/1975 | Adler et al. | 105/299 |

*Primary Examiner*—Joseph F. Peters, Jr.
*Assistant Examiner*—Howard Beltran
*Attorney, Agent, or Firm*—Richard J. Myers

[57] ABSTRACT

A door operating mechanism for a bottom dump hopper car including a plurality of transversely mounted bottom discharge gates arranged in oppositely opening pairs and operatively connected by compression struts to pendulously mounted vertical levers. The levers are movable divergently outward by linkages connecting them to a lever mounted on a longitudinally extending rotatable actuating shaft. The invention further provides that in the locked position the vertical levers and compression struts be in an overcenter position relative to each pair of associated discharge gates, thereby assuring positive locking of the mechanism.

10 Claims, 5 Drawing Figures

RAILWAY HOPPER CAR DOOR OPERATING MECHANISM

BACKGROUND OF THE INVENTION

1. Field of the Invention

This invention pertains to railway hopper cars and door operating mechanisms.

2. Description of the Prior Art

The prior art door operating mechanisms are exemplified by the operating mechanism shown in the Floehr U.S. Pat. No. 3,316,857 which provides for opening and closing of a plurality of transversely disposed discharge gates in unison, but requires longitudinally reciprocable operating shafts. Experience has shown that such devices are relatively difficult to fabricate and difficult to repair due to the close tolerances essential to assure proper sealing of discharge gates. Additionally, warping-like jamming flexure of a fully loaded hopper car can act to bind the operating mechanism and thus render the mechanism marginally serviceable or inoperative after extended use. Other arrangements used to open transverse discharge gates such as the Novelli U.S. Pat. No. 3,122,106 utilize a vertically disposed piston which consumes much space and is difficult to reach for repair and maintenance.

The present invention improves upon prior designs by utilizing a longitudinally rotatable actuating shaft operatively connected to an arrangement of pendulously mounted levers and compression struts for selective operation of the hopper discharge gates. An overcenter locking configuration of the vertical levers and compression struts assures positive locking of the discharge gates when closed, and simplicity of design facilitates fabrication and field service and repair or maintenance.

SUMMARY OF THE INVENTION

This inventionpertains to an overcenter door operating mechanism for a railway hopper car which provides for the opening of a plurality of transversely disposed discharge gates by means of a longitudinally extending actuating shaft shielded beneath the hoppers of the car.

Each oppositely opening pair of transversely disposed discharge gates is so constructed and arranged as to be separated from its respective pair by the center sill of the car and each pair is operatively connected by compression struts to a vertical lever pendulously mounted to the cross-ridge web of the car. The range of motion of these levers is limited by guiding members to a vertical plane midway between the gates of each pair. These guiding members extend from the center sill to the side sill of the car and contain a cross-bolt which acts as a positive lock to limit the inward travel of the vertical levers when in the closed position. Each door of the pair is operatively connected by means of a compression strut to the vertical lever of that pair. The vertical levers and the compression struts are arranged to be positioned in an overcenter locking configuration when in the closed position to positively secure the discharge gates in their respective positions. Each vertical lever is attached by a linkage to one arm of a double-arm lever affixed to the longitudinally rotatable torque tube located in the longitudinal hood above the center sill and running between the ends of the car. The tube is rotated by appropriate means but the preferred embodiment incorporates a pneumatic cylinder located vertically below the center cross-ridge of a car attached to a lever affixed perpendicularly to the mid-point of the torque tube. Actuation of the cylinder when the discharge gates are in the closed position causes the torque tube to rotate, thus causing each arm of the double-arm levers to push outward on its linkage. The vertical levers are swung outward by the linkages, drawing their respective compression struts with them through and beyond the center position, causing the discharge gates to open.

To close the gates after discharge of the lading, the pneumatic cylinder travel is reverse rotating the torque tube in the opposite direction, causing the gates to close. The vertical levers and compression struts pass through the center position and move to their overcenter closed positions. The vertical levers are restrained from further inward travel by cross-bolt stops incorporated into the guide member channels.

The two-piece compression struts include a strut end that rotates within the strut tube to accomodate relative angular rotation of the vertical levers and the discharge doors during operation. Spherical pins operatively connect the compression struts to the vertical levers to further accomodate this angular rotation. The arrangement of one vertical lever connected by compression struts to each gate on an oppositely opening pair elimiates longitudinal stress on the vertical lever and causes each gate of the pair to act as a lock against accidental opening for the other.

To accomodate the movement of the vertical levers and compression struts from an overcenter configuration, a sufficient clearance is allowed between the discharge gates and discharge openings when the doors are in the closed position. This permits smooth operation of the invention, yet maintains the security of the gate seals because of the conventional relative overlapping configuration of the discharge gates and openings.

The invention may be operated either by electrical or mechanical means, but the preferred embodiment includes a pneumatic cylinder supplied by an air reservoir with sufficient reserve to completely cycle the gates several times permitting discharge of the lading at any discharge site without the aid of trackside equipment.

DESCRIPTION OF THE PREFERRED EMBODIMENT

Figure 1:
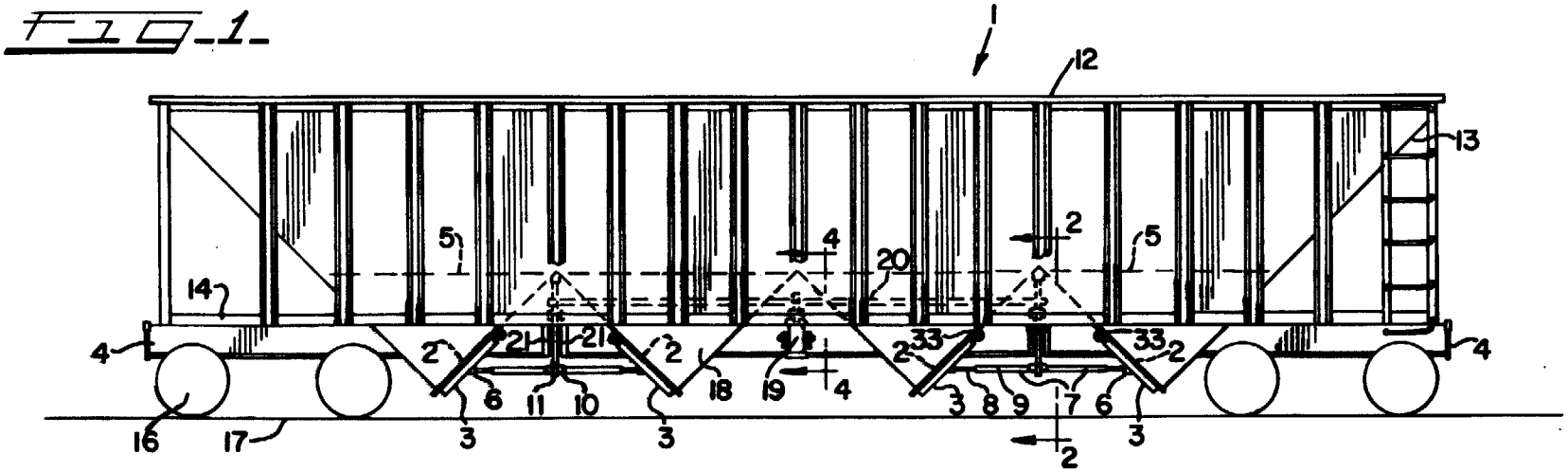
FIG. 1 is a side elevation view of a hopper car, showing a preferred embodiment of the dumping mechanism of the present invention in the closed position.

By referring to FIG. 1, there shown is a hopper car 1 and including the usual transversely spaced side walls 12 and associated slope sheets 13. Longitudinally extending side sill units 14 extend along the lower margin of the side walls 12. The hopper car may include a longitudinally extending continuous center sill 4 which projects outwardly from opposite ends of the car. The vehicle is supported on the usual wheeled trucks 16 which ride on tracks 17.

The improved dumping mechanism is of the type that dumps between the rails and includes a plurality of hoppers 18 which are divided transversely of the car by the center sill 4 extending longitudinally of the car and including opposing discharge openings 2.

Conventional discharge gates or doors 3 are provided for closing the associated discharge openings 2 of each adjacent pair of hoppers 18 and are attached by transverse hinges 33 at the top of the discharge opening 2, and in closing swing away from each other to the inclined or sloping closed position shown in FIG. 1.

The discharge gates 3 are held in position by compression struts 7 including longitudinally rotatable strut end 8 and strut tube 9, and are operatively connected by pivot 6. The compression struts 7 are operatively connected with a ball and socket type connection by spherical pins 10 to vertical levers 11, the vertical levers 11 being confined to travel in a vertical, transverse plane by guiding members 21.

Figure 4:
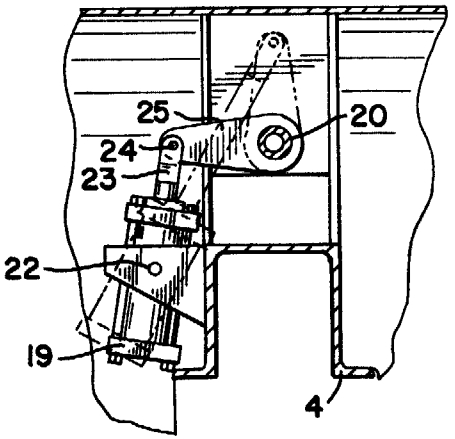
FIG. 4 is a transverse fragmentary sectional view on an enlarged scale taken along lines 4—4 of FIG. 1 showing the vertically mounted pneumatic cylinder and its linkage to the longitudinal torque tube.

FIG. 1 further illustrates the vertical placement position of pneumatic cylinder 19 on center sill 4 and the longitudinal placement of torque tube 20 within the longitudinal hood 5. FIG. 4 illustrates the vertical placement of pneumatic cylinder 19 on center still 4, connected by means of pivot 22. Pneumatic cylinder piston 23 is operatively connected by pivot 24 to lever 25 which is rigidly attached perpendicularly to torque tube 20.

Figure 2:
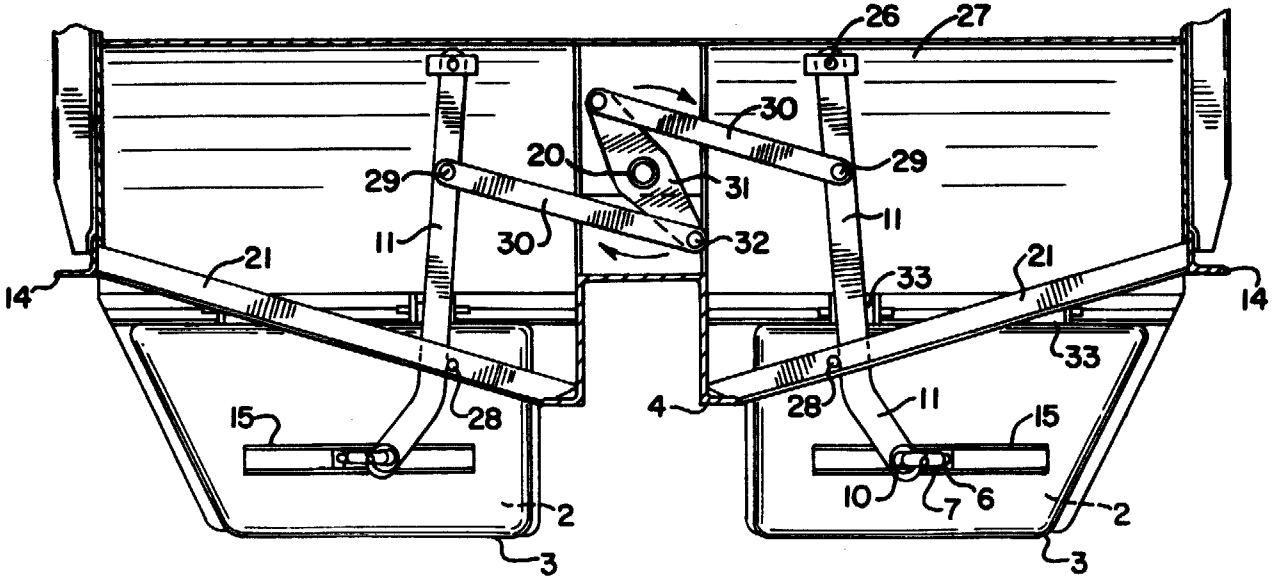
FIG. 2 is a transverse fragmentary sectional view on an enlarged scale taken along lines 2—2 of FIG. 1.

Referring to FIG. 2, discharge gates 3 are shown in their closed position over discharge openings 2, connected by pivots 6 to compression struts 7, which in turn are connected by spherical pin 10 of the ball and socket connection to vertical levers 11. Pivots 6 are pivotally connected to spreaders 15 which are transversely rigidly attached to discharge gates 3, spreaders 15 being channel members which act to resist bending stress generated at discharge gates 3. Vertical levers 11 are pendulously connected at pivots 26 to cross-ridge web 27 and are guided in movement by guiding members 21, rigidly connected between center sill 4 and side sills 14. In the closed position, vertical levers 11 rest against cross-bolts 28 in order to restrict their travel inward within guiding members 21 and act as positive locks so that discharge gates 3 will not mistakably open in the closed position.

Vertical levers 11 are operatively connected at pivot 29 to linkages 30, which exert outward force on vertical levers 11 when the double-arm lever 31 is rotated in the direction as indicated by the arrows in FIG. 2. Linkages 30 are operatively attached to double-arm lever 31 at pivots 32. Double-arm lever 31 is rigidily affixed to torque tube 20 so that rotation of double-arm lever 31 is restricted to a vertical plane.

Figure 3:
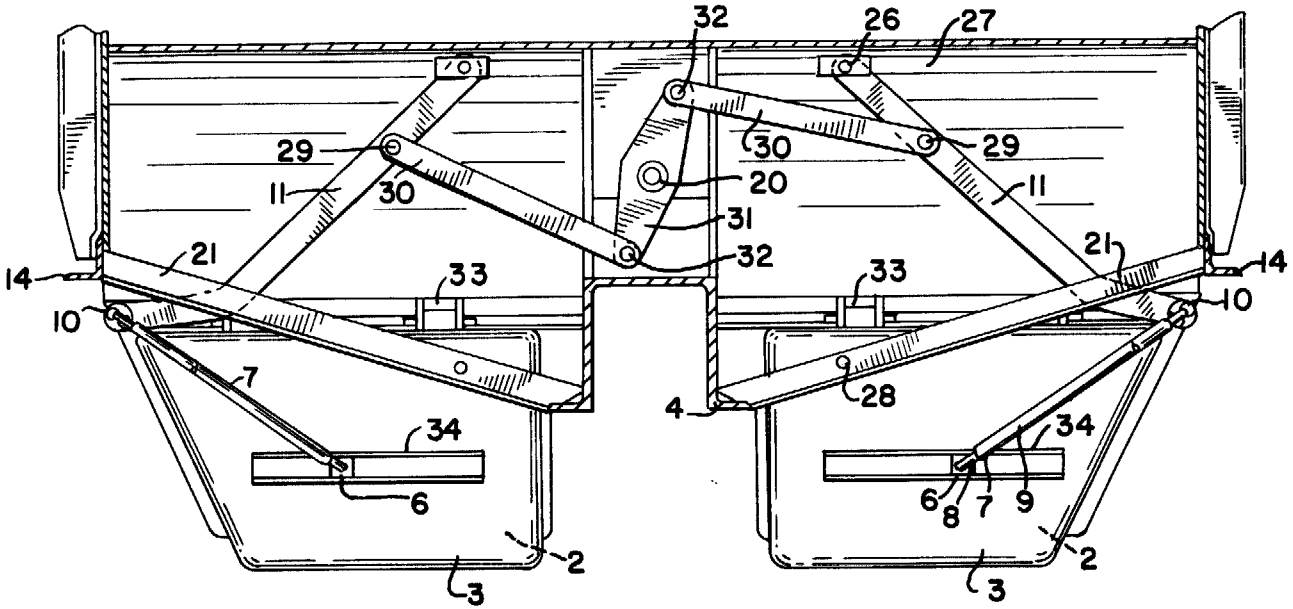
FIG. 3 is a transverse fragementary sectional view on an enlarged scale taken along lines 2—2 of FIG. 1.

Referring to FIG. 3, double-arm lever 31 is shown in its open position. The rotation of double-arm lever 31 acts through pivots 29 to cause linkages 30 to move away from the longitudinal axis of the car. Linkages 30 act against vertical levers 11 through pivots 29, thereby causing the divergent swinging of vertical levers 11. The divergent motion of vertical levers 11 causes compression struts 7, including strut end 8 and strut 9, to move from their overcenter locking position through the center position, and then be drawn outward by vertical levers 11. Sufficient clearance between discharge gates 3 in their closed position and discharge openings 2 accomodates smooth movement of the compression struts 7 and vertical levers 11 through the overcenter position. Rotation of strut end 8 within strut tube 9 accomodates relative angular rotation of compression struts 7 and discharge gates 3.

Spherical pin 10 permits proper angular realignment of vertical levers 11 and compression struts 7 with respect to each other. The outward motion of compression struts 7 causes discharge gates 3 to be opened, and the lading to be discharged through discharge opening 2.

Figure 5:
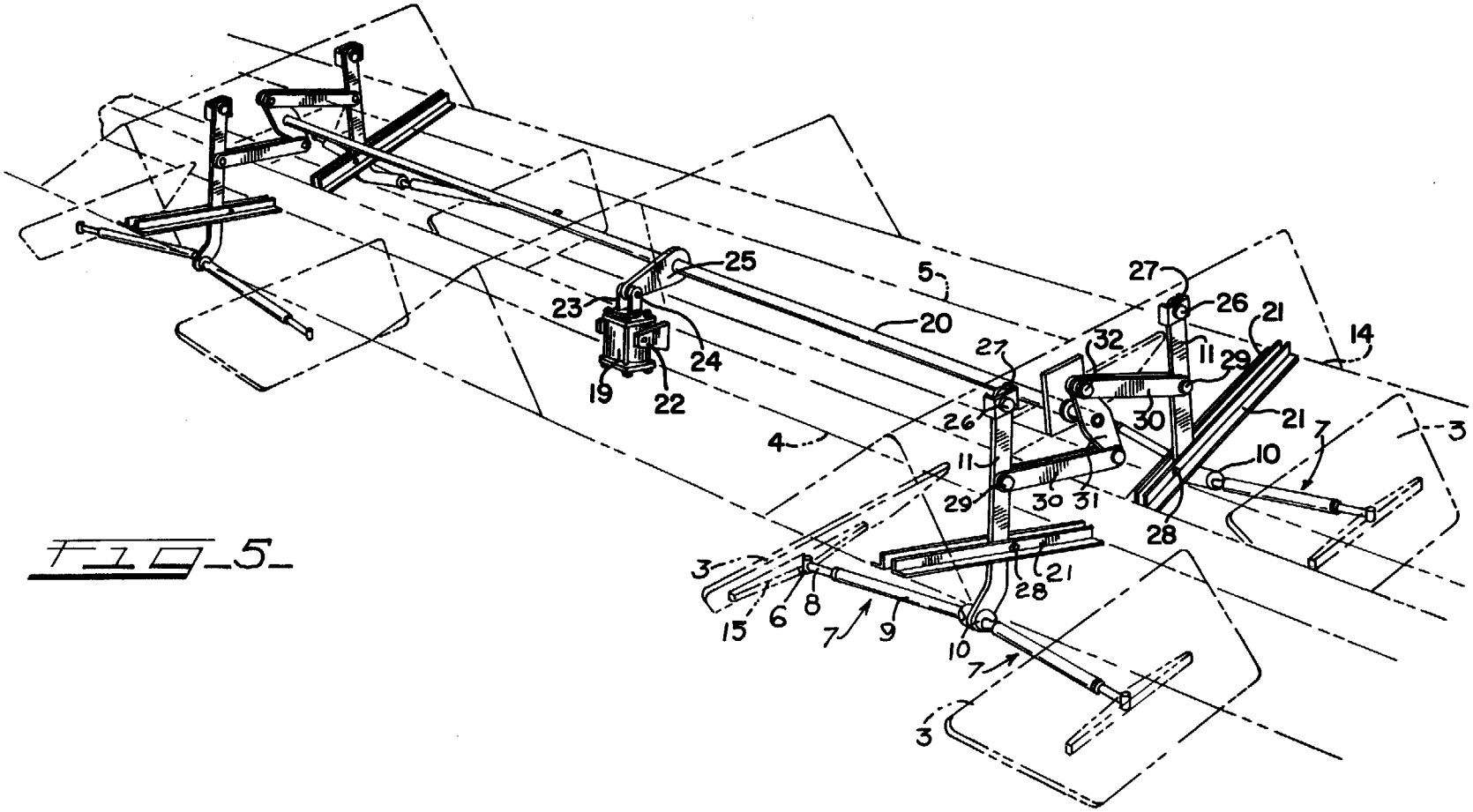
FIG. 5 is a perspective view of all operative components of the invention with the broken lines indicating the relative position of the hopper car body and discharge gates to the operating mechanism.

FIG. 5 illustrates the placement of essential elements of the invention in a closed position as envisioned within a conventional hopper car. Centrally located pneumatic cylinder 19, pivotally mounted to center sill 4 by pivot 22, is operatively connected by its cylinder piston 23 to lever 25 by pivot 24. Lever 25 is rigidly attached perpendicularly to longitudinally rotatable torque tube 20. Torque tube 20 extends beneath the longitudinal hood 5 to end cross-ridge webs 27 where double-arm levers 31 are rigidly affixed to torque tube 20. Double-arm levers 31 are operatively connected by pivots 32 to linkages 30, which in turn are operatively connected to vertical levers 11 through pivots 29. Vertical levers 11, which are pendulously connected by pivots 26 to cross-ridge webs 27, are operatively connected by spherical pins 10 to compression struts 7, which include strut tubes 9 and strut ends 8. Strut ends 8 of compression struts 7 are pivotally attached to spreaders 15, which are transversely rigidly affixed to the outside surface of discharge gates 3. Vertical levers 11 are confined to travel within a vertical plane by guiding members 21 which are rigidly attached between center sill 4 and side sills 14. Cross-bolts 28 act as positive stops to the inward travel of vertical levers 11 and provide a positive lock to prevent accidental opening of discharge gates 3.

THE OPERATION

In operation, the door opening mechanism of the present invention is selectively operable independently of track side equipment.

When the hopper car is in the position of desired discharge of its lading, either manual or automatic means are employed to activate penumatic cylinder 19. The activation of pneumatic cylinder 19 causes pneumatic cylinder piston 23 to act through pivot 24 to rotate lever 25, thereby causing torque tube 20 to rotate longitudinally. Pneumatic cylinder pivot 22 allows pneumatic cylinder 19 to properly align itself with respect to center sill 4.

As torque tube 20 rotates, double-arm levers 31, rigidly affixed to torque tube 20, rotate through a corresponding angle. The rotation of double-arm levers 31 causes linkages 30 to move outward. The outward motion is transmitted by pivots 29 to vertical levers 11. Transversely extending guiding members 21 restrict vertical levers 11 to motion in a vertical plane only. The outward motion of vertical levers 11 forces them from their overcenter positions with respect to compression struts 7 and discharge gates 3. Sufficient clearance is allowed between discharge gates 3 and discharge openings 2 to accomodate smooth movement of vertical levers 11 and compression struts 7 through their center positions relative to gates 3. As the bottoms of vertical levers 11 continue to rotate and move outward away from center sill 4 past their center positions, compression struts 7 are drawn in the same direction, properly aligning themselves between vertical levers 11 and discharge gate pivots 6 by means of spherical pins 10 and rotation of strut end 8 within strut tube 9. The realignment of compression struts 7 cause spreaders 15 and the attached discharge gates 3 to be drawn from their closed positions, allowing the lading to be discharged through discharge openings 2.

When the discharge of the lading is complete, pneumatic cylinder 19 is caused to operate in reverse. Pneumatic cylinder piston 23 pulls on lever 25 through pivot 24 causing lever 25 and torque tube 20 to rotate back to their closed positions. Double-arm lever 31 rotates correspondingly, causing linkages 30 to be pulled inward. Connecting links 30 act upon vertical levers 11 through pivots 29 causing the vertical levers 11 to pivot inward to their closed positions. The ends of compression struts 7 connected to levers are drawn inward with vertical levers 11, causing compression struts 7 to push against the associated discharge gate spreaders 15 and discharge gates 3, returning the latter to their closed positions covering discharge openings 2. As vertical levers 11 move to their overcenter position relative to compression struts 7 and discharge gates 3, discharge openings 2 are completely closed and vertical levers 11 are limited from further inward travel to the center sill 4 by cross-bolts 28. Discharge gates 3 are now positively locked in the closed position because of the limitation by cross-bolts 28 upon further inward travel of vertical levers 11. In the closed position, each compression strut 7 of each vertical lever 11 acts together with the other compression strut 7 of that vertical lever 11 to cancel longitudinal stresses on that lever 11, further facilitating durability of the mechanism and security of the lading. The air supply to pneumatic cylinder 19 may now be disconnected, and the hopper car is ready for relocation and reloading.

What is claimed is:

1. A bottom dump railway hopper car having an underframe and a hopper having a pair of laterally spaced bottom discharge openings and a pair of discharge gates associated therewith hinged from said hopper for movement between open and closed positions, the improvement comprising a gate operating mechanism operatively associated therewith comprising:

an actuating shaft rotatable about its longitudinal axis in a first direction to open and a second direction to close said discharge gates and located between the ends of said hopper car, lever means rigidly affixed to said actuating shaft and extending outwardly therefrom, vertical levers pendulously connected to said underframe of said hopper car and having pivot means attaching said vertical levers and having lower ends, linkages operatively connecting said lever means to each vertical lever in order to swing said vertical levers outward when said lever means rotate in said first direction, strut means having first and second ends, said first ends being pivotally connected to the lower ends of said vertical levers, and said discharge gates hingly connected to said hopper and having a pivotal connection with the second ends of said strut means.

2. The invention in accordance with claim 1, and fluid power actuating means for selectively rotating said actuating shaft in clockwise and counterclockwise directions.

3. The invention in accordance with claim 1, and said hopper car having a center sill and side sills spaced outwardly therefrom;

said vertical levers being restricted in travel to a vertical plane by guiding members running essentially between the center sills and the side sill of the car.

4. The invention in accordance with claim 3, and said guiding members including means limiting lateral, inward movement of said vertical levers.

5. The invention in accordance with claim 1, and said strut means having a ball and socket connection to said vertical levers.

6. The invention in accordance with claim 1, and said strut means comprising:

a strut tube containing a biasing spring and a telescoping strut end therein;

said strut end being longitudinally resiliently compressible within the associated strut tube.

7. The invention in accordance with claim 1, and said gate attachment means comprising:

spreaders affixed transversely to the outside surface of said discharge gates providing mounting means for said pivotal connection to the second end of said strut means.

8. The invention in accordance with claim 1, and said vertical levers being in an over-center position with respect to said strut means and said discharge gates when the latter are in their respective closed positions whereby the first end of the strut means is located more inwardly of the hopper car than the location of the second end of the strut means attached to the discharge gates.

9. The invention in accordance with claim 1, and said strut means having telescoping means being compressed when said discharge gates are in their closed position.

10. A bottom dump railway car having an underframe and a hopper having discharge openings arranged in pairs on opposite sides of the car center sill and swinging gates associated therewith, said swinging gates being hinged from said hopper for movement between open and closed positions and to swing toward the adjacent swinging gate of the associated pair, an improved swinging gate operating mechanism including:

a selectively movable actuating member mounted on the underframe, pivot means attaching a vertical lever to the car underframe and disposing the vertical lever for transverse swinging movement away from the center sill to open the swinging gates and toward the center still to close the swinging gates;

linkage means operatively connecting the acutating member and said vertical lever such that movement of the actuating member causes the vertical lever to swing, said vertical lever having a lower portion; and strut means extending in opposite directions from the lower portion of the vertical lever and connecting the vertical lever and associated swinging gates, whereby selective movement of said vertical lever causes said strut means to be drawn in the direction of movement, thereby opening and closing said discharge openings.

* * * * *